United States Patent [19]

Villa

[11] 4,223,446

[45] Sep. 23, 1980

[54] LEAD SIGHT APPARATUS FOR SHOTGUNS

[76] Inventor: John N. Villa, 6942 W. Olive, Peoria, Ariz. 85345

[21] Appl. No.: 5,209

[22] Filed: Jan. 22, 1979

[51] Int. Cl.[3] ..... F41G 1/00; F41G 11/00

[52] U.S. Cl. ..... 33/261

[58] Field of Search ..... 33/261, 233

[56] References Cited

U.S. PATENT DOCUMENTS

| | | | |
|---|---|---|---|
| 2,092,356 | 9/1937 | Prather | 33/261 |
| 2,458,638 | 1/1949 | Pretzer | 33/261 |
| 2,730,806 | 1/1956 | Williams et al. | 33/261 |
| 4,112,583 | 9/1978 | Castilla | 33/261 |

*Primary Examiner*—Steven L. Stephan

*Attorney, Agent, or Firm*—H. Gordon Shields

[57] ABSTRACT

Lead sight apparatus for shotguns is disclosed which comprises a pair of rings of a predetermined diameter spaced apart a predetermined distance from the barrel of a shotgun and extending outwardly from the shotgun barrel.

2 Claims, 11 Drawing Figures

LEAD SIGHT APPARATUS FOR SHOTGUNS

BACKGROUND OF THE INVENTION

1. Field of the Invention

This apparatus relates to shotgun sights and, more particularly, to apparatus for determining the amount of lead for a moving target for a shotgun.

2. Description of the Prior Art

Shotguns do not have "sights" as an integral part of the shotguns, as do rifles. Rather, the type of shooting, including hunting, skeet, and trap shooting, common with shotguns is substantially different from the type of shooting normally done with rifles. The target of a shotgunner is normally always moving, which requires the shotgunner to "lead" his target by an appropriate amount to insure hitting the target effectively. Moreover, except for the use of rifled slugs, shotgun shells include a plurality of shot, ranging in size from rather small to, in some cases, rather large. The presence or existence of the shot causes, or results in, a pattern which expands as the shot leaves the barrel of the shotgun. The effective range of shot is about forty yards. That is, beyond about forty yards the pattern of the shot is so scattered or of such low density that the likelihood of effectively hitting a target is minimized.

As is well understood, the complexity of proper lead in sighting a shotgun depends upon several factors, such as the gauge of the shotgun, the choke of the barrel, the size (and accordingly the quantity) of the shot used in the shotgun shell, the size of the target, the speed of the target, and the angle of flight between the target and the shotgunner.

To assist a shotgunner in aiming his shotgun properly by incorporating a proper amount of lead in his aiming or sighting, practice is important. However, practice alone may not be sufficient. Mechanical apparatus may also be used to help aim a shotgun.

In order to accomplish the proper aiming or sighting, it has been suggested that a pair of rings may be mounted with respect to a shotgun barrel to be used, either in conjunction with a rear sight, as disclosed in U.S. Pat. No. 2,092,356, or without a rear sight, as shown in U.S. Pat. 2,458,638.

The U.S. Pat. No. 2,092,356 patent discloses a pair of rings disposed above a shotgun barrel and extending outwardly from the shotgun barrel. The rings are mounted in a bracket which enables them to be moved outwardly with respect to each other, and also with respect to the shotgun barrel, an amount as determined to be suitable. The rings are held in position on their arms by a set screw. The rings are in turn secured to a single barrel of a shotgun by a supporting ring. The aiming rings are of a fixed diameter and are disposed above the horizontal diameter of the shotgun barrel. As a matter of fact, the horizontal diameter of the aiming or sighting rings is substantially above the horizontal diameter of the shotgun barrel.

The 2,458,638 patent also discloses a pair of rings disposed outwardly and above a shotgun barrel. The rings are of a fixed distance outwardly from the barrel of the shotgun. The sighting rings are held in place on the shotgun barrel by a generally triangular frame. Different frames may be used for single barrel shotguns, double barrel shotguns, or over-under shotguns.

Several problems are inherent in the prior art which is typified by the two patents discussed above. For example, the sighting rings are of a fixed diameter without regards to the type of target for the shotgun. Moreover, the sighting rings are disposed above the horizontal axis of the shotgun barrel. In the 2,458,638 patent, the sighting rings are disposed at a fixed distance from the shotgun barrel, while in the 2,092,356 patent the rings may be adjusted, as desired. However, the rings in the 2,092,356 patent may also be disposed outwardly with respect to each other at various distances from the center line of the shotgun barrel. Additionally, it appears that the size of the rings shown in both patents is independent of, or irrespective of, the gauge of the shotgun with which the sighting rings are to be used.

SUMMARY OF THE INVENTION

The apparatus disclosed and claimed herein comprises a pair of sighting rings of a predetermined diameter spaced apart from the center line of a shotgun barrel a predetermined distance and located on the horizontal diameter of the shotgun barrel so that the horizontal diameter or diameters of the sighting rings are coextensive with, or located on, the horizontal diameter of the shotgun barrel. The diameter of the sighting rings, the distance the sighting rings are located with respect to the vertical diameter or center line of the shotgun barrel are both correlated to the gauge of the shotgun and to the game or prospective target with which the apparatus is to be used.

Among the objects of the present invention are the following:

To provide new and useful shotgun aiming apparatus;

To provide new and useful apparatus for determining the proper lead for shooting a moving target with a shotgun;

To provide new and useful apparatus for determining the proper lead for shooting various targets with shotguns; and To provide new and useful ring apparatus for sighting a shotgun.

DESCRIPTION OF THE PREFERRED EMBODIMENT

Figure 1:
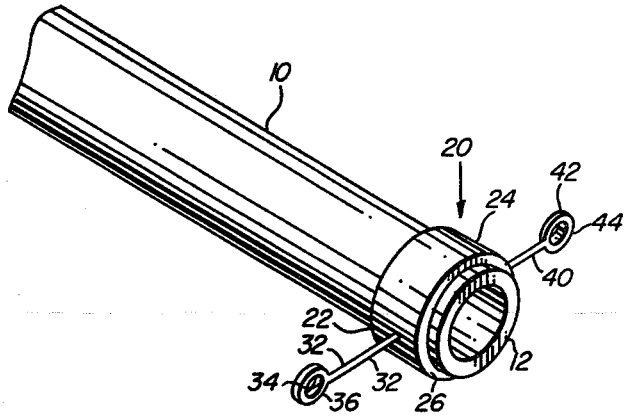
FIG. 1 is a perspective view of a portion of a shotgun barrel with the apparatus of the present invention disposed on the barrel.

FIG. 1 is a perspective view of a portion of a shotgun barrel 10 to which is secured lead sight apparatus 20 embodying the present invention. The shotgun barrel 10 includes a muzzle 12, and the lead sight apparatus 20 is disposed over the exterior of the shotgun barrel and adjacent the muzzle 12.

Figure 2:
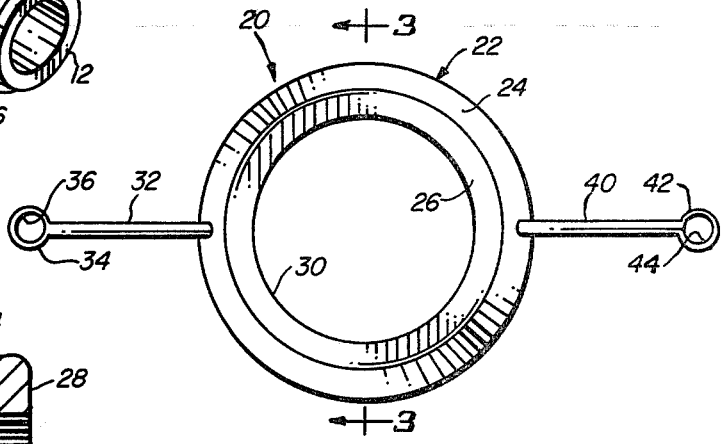
FIG. 2 is an end view of the apparatus of FIG. 1.
Figure 3:
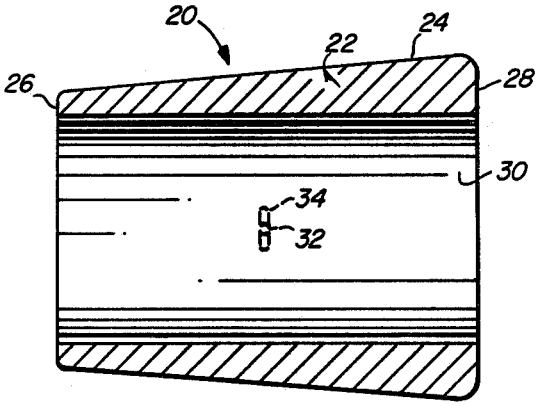
FIG. 3 is a view of the apparatus of FIG. 2 taken generally along line 3—3 of FIG. 2.

FIG. 2 is an end view of the lead sight apparatus 20, and FIG. 3 is a view in partial section of the lead sight apparatus 20 taken generally along line 3—3 of FIG. 2. For the following explanation of the lead sight apparatus 20, reference will be made to FIGS. 1, 2, and 3.

The lead sight apparatus 20, shown in FIG. 1 as disposed on the end of a shotgun barrel 10, adjacent the muzzle 12, includes a barrel clamp 22 and a pair of arms 32 and 40 extending outwardly from the barrel clamp 22, with a pair of rings 34 and 42 secured to the outer or distal ends of the arms 32 and 40, respectively. The barrel clamp 22 includes a sloping outer surface 24 which extends between a front face 28 and a rear face 30. An interior bore 26 also extends between the faces 28 and 30. The diameter of the interior bore 26 is substantially the same as the diameter of the exterior of the shotgun barrel 10. Accordingly, when the lead sight apparatus 20 is disposed on the barrel, a relatively tight engagement between the interior bore 26 and the exterior of the barrel 10 occurs to prevent the lead sight apparatus 20 from easily coming off and from moving axially along the barrel, or from rotating on the barrel. The lead sight apparatus 20 is accordingly held in position and the position is maintained during the use of the shotgun.

The faces 26 and 28 are substantially parallel to each other, and are generally perpendicular to the longitudinal axis of the bore 30. The outer surface 24 of the barrel clamp 22 is sloping, as best shown in FIGS. 2 and 3, simply for the convenience of securing the lead sight apparatus 20 to the shotgun barrel 10. If desired, the outer surface may be cylindrical and substantially parallel to the interior bore 30. However, with a sloping face, it is somewhat easier and more convenient to grasp the sloping surface in order to securely place the lead sight apparatus 20 on the shotgun barrel 10.

Secured to the barrel clamp 22, and extending outwardly from the barrel clamp on a diameter thereof, which diameter, when the lead sight apparatus 20 is disposed on a shotgun barrel 10, as shown in FIG. 1, is substantially horizontal, are a pair of arms 32 and 40. The arms 32 and 40 are aligned with each other and with the horizontal diameter of the barrel clamp 22 for sighting purposes. That is, as shown in FIG. 1, when the lead sight apparatus 20 is disposed on the end of the shotgun, the arms 32 and 40 are on the horizontal diameter of the shotgun barrel. In this manner, when the shotgun is pointed in an appropriate direction for shooting purposes, as long as the shotgun is held in the proper vertical manner, the arms 32 and 40 will remain on the horizontal diameter of the shotgun barrel.

At the outer or distal end of the arms 32 and 40 are a pair of rings 34 and 42, respectively. The rings 34 and 42 are secured to the arms 32 and 40, respectively, so that the arms, if extended through the rings, would intersect the rings on a diameter. Thus, the rings may be considered, with respect to their orientation, as miniature barrels whose location, as long as the lead sight apparatus 20 remains appropriately secured to the shotgun barrel 10, is on the horizontal diameter of the shotgun barrel. In the center of each ring is a bore or hole, identified by reference numerals 36 and 44 of the rings 34 and 42, respectively.

The lead sight apparatus 20 is used when hunting various types of game birds or fowl. Since each type of bird or fowl is different with respect to both size and speed of flight, in order to properly gauge or judge the lead required in the proper pointing or aiming of a shotgun, the length of the respective arms and the size of the respective rings varies for each type of game. Moreover, the effective range of a shotgun varies, and if a shot is taken at a target which is beyond the effective range of the shotgun, either the shot is completely wasted or the bird may be wounded to the extent that injury is inflicted upon the bird that will not result in a clean kill shot. Therefore, the bird is simply injured which results in pain and perhaps some degree of disability to the bird, neither of which is desired by a sportsman hunter.

With the apparatus of the present invention, the target game is aligned with one ring or the other, depending on the direction of flight of the game, with the ring being disposed or superimposed over the body of the bird. The apparatus is not designed for straightaway shots, or shots in which the game is moving away from the hunter within about sixty degrees of arc in front of the hunter.

The size of the rings is correlated with the optimum distance for which a particular apparatus is designed, and the overall length of the arms and the rings is correlated to both distance and speed of the target game. A ring should be small enough to be correlated with the overall length of an arm, and yet be large enough to allow game being hunted to be clearly identified through it.

From the foregoing discussion, it may be seen that the location of a ring, the size of a ring, and the distance of the ring from the barrel of a shotgun are coordinated by the apparatus of the present invention to provide an effective lead sight for pointing or aiming a shotgun at any particular type of bird or fowl. As is shown below in the table, both the distance and the size of the ring are varied for the different type of bird or fowl being hunted. However, the location of the arm and the ring, which is on the horizontal diameter of the shotgun barrel, remains in such position to actually simulate the location of the barrel. As may be noted from the above discussion with respect to the prior art, the teaching of the location of the ring and the arm is contrary to the teachings of the prior art, most of which locate a ring at the top of a barrel or above a barrel. Moreover, there is no teaching in the prior art for correlating either the size of a ring or the location of the ring with respect to the distance from the barrel of a shotgun for a particular type of game being hunted.

Figure 4:
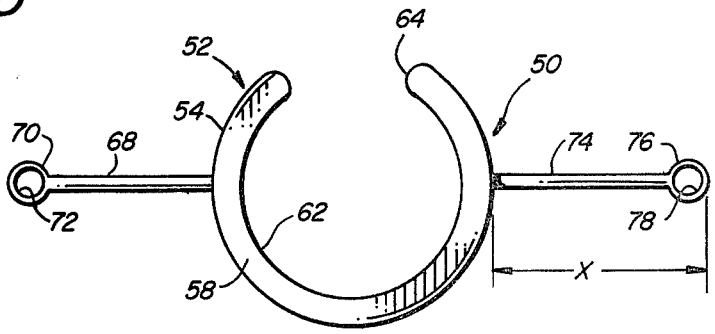
FIG. 4 is an end view of an alternate embodiment of the apparatus of FIGS. 1–3.

FIG. 4 is a front view of an alternate embodiment of the apparatus of FIGS. 1, 2, and 3, comprising a lead sight apparatus 50 having a cylindrical barrel clamp 52 with a slot 64 extending along the longitudinal axis of the barrel clamp 52, which axis is along the longitudinal axis of the shotgun barrel. This allows the lead sight apparatus 50 to be manufactured in a somewhat simpler manner than the lead sight apparatus 20 of FIGS. 1, 2, and 3, and also allows the barrel clamp 52 to be manufactured slightly smaller than the expected outside barrel diameter so as to provide an inherent spring bias to securely hold the lead sight apparatus onto the barrel of a shotgun.

Figure 5:
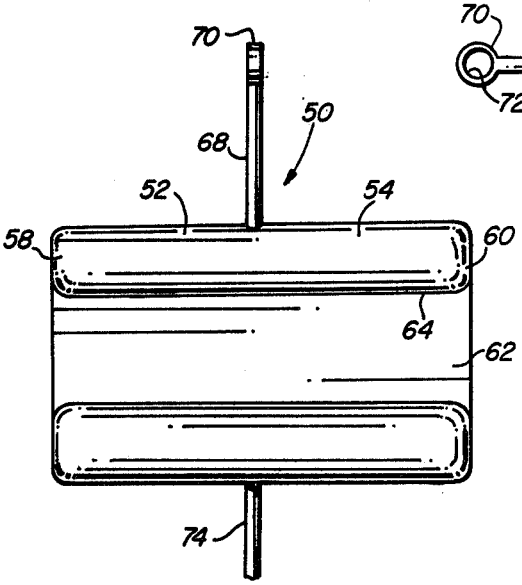
FIG. 5 is a vertical plan view of the apparatus of FIG. 4.

FIG. 5 is a top view of the lead sight apparatus 50 of FIG. 4. As shown in both FIGS. 4 and 5, the barrel clamp 52 is generally cylindrical in configuration, with the slot 64 extending longitudinally of the barrel clamp. The outer surface 54 of the barrel clamp 52 is substantially parallel to the bore 62. The outer surface 54 extends from a front face 58 to a rear face 60, both of which faces are substantially parallel to each other. The taper of the outer surface found in the embodiment of FIGS. 1, 2, and 3, with respect to the lead sight apparatus 20, is not found in the embodiment of the lead sight apparatus 50 of FIGS. 4 and 5. Rather, the outside surface 54 is substantially parallel to the inner bore 62 which receives a barrel of a shotgun.

The slot 64 extends the full axial length of the barrel clamp 52 between the front and rear faces 58 and 60, respectively. The slot allows for a spring bias, as indicated above, to help secure the barrel clamp 52 to the barrel of a shotgun.

Extending outwardly substantially perpendicular to the longitudinal axis of the barrel clamp 52, and along a diameter of the bore 62, is a pair of arms 68 and 74. The arms 68 and 74 are aligned with each other, as discussed above with respect to the arms 32 and 40 of lead sight apparatus 20. The arms 68 and 74, like the arms in the other embodiments herein, should be disposed substantially perpendicular to the vertical axis of a shotgun when the lead sight apparatus is secured to a shotgun and is used therewith. The arms are also perpendicular to the longitudinal axis of the shotgun barrel, as discussed herein.

Arm 68 includes a ring 70 at its distal end, remote from the barrel clamp 52. The ring 70 includes a hole or aperture 72 extending through the ring. The ring 70 is secured to the arm 68 centrally with respect to the ring and its hole or aperture 72, such that an extension of the arm 68 would extend through the ring 70 on a diameter thereof.

The arm 74 includes a ring 76 on its distal end, remote from the barrel clamp 52. A hole or aperture 78 extends through the ring 76. As in all the embodiments of the present invention, the bore or aperture or hole 78 of the ring 76 is secured to its arm 74 symmetrically so that an extension of the arm 74 would extend through the ring 76 on a diameter of the ring. It will be noted that the terms "bore," "hole," or "aperture," all refer to the center, circular relieved portion of the ring which is secured to the distal ends of the arms of the lead sight apparatus disclosed in the present invention. Each ring is secured to its arm substantially symmetrically, and the arms are secured to their respective barrel clamps also symmetrically and in a direct alignment with respect to each other and on a diameter of the barrel clamp bore.

Figure 6:
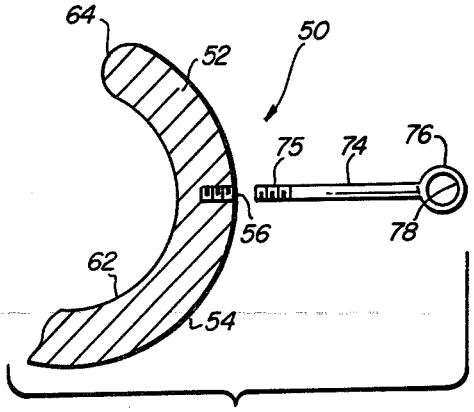
FIG. 6 is a view in partial section illustrating the securing of a sighting ring to the apparatus of FIG. 5.

FIG. 6 is a view in partial section of a portion of the lead sight apparatus 50 of FIGS. 4 and 5. It illustrates the securing of an arm 74 to the barrel clamp 52. The barrel clamp 52 includes a tapped aperture 56 which extends radially inwardly from the outer surface 54 of the barrel clamp 52. The tapped aperture or hole 56 receives a threaded portion 75 of the arm 74. Thus, the arm 74 may be threadedly secured to the barrel clamp 52.

Since the length of the rod or arm 74 is important with respect to the apparatus of the present invention, the rod or arm 74 is inserted a specific or predetermined length into the bore 56, and is preferably cemented in place once the appropriate distance has been obtained and after the ring 76 has been properly oriented. The ring 76, as with the rings of the other arms of the embodiments of the present invention, is disposed substantially perpendicular to the longitudinal axis of the bore of a barrel clamp which receives a shotgun barrel. As discussed above, the ring is then oriented, in a manner of speaking, to simulate the muzzle of a shotgun barrel.

Figure 7:
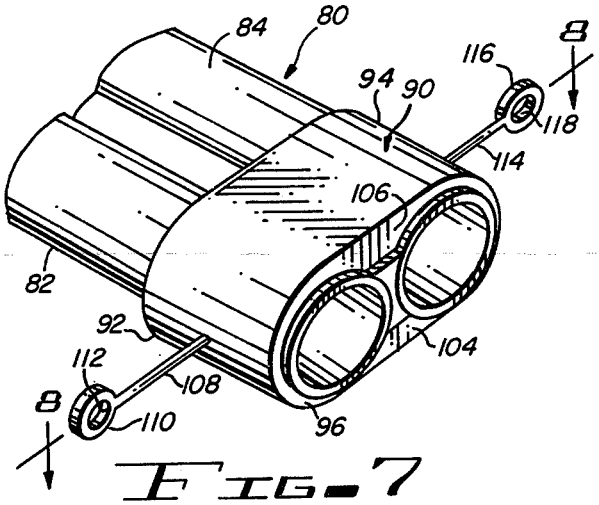
FIG. 7 is a perspective view of the apparatus of the present invention illustrating the sighting ring apparatus with a double-barrel shotgun.

FIG. 7 is a perspective view of an alternate embodiment of the present invention, comprising a lead sight apparatus 90 secured to a double barrel shotgun 80. The shotgun 80 includes a barrel 82 and a barrel 84 which are oriented in a side-by-side manner, typical of double-barrel shotguns, and as opposed to a superimposed or over/under barrel arrangement. The over/under shotgun barrel arrangement is shown below in FIG. 10.

The lead sight apparatus 90 includes a barrel clamp 92 with a pair of arms 108 and 114 extending outwardly from the barrel clamp 92. The barrel clamp 92 includes a sloping outer surface 94 which extends between a front face 96 and a rear face 98. The taper or slope of the outer surface 94 is upwardly and outwardly from the front face 96 to the rear face 98, similar to the slope of the outer surface 24 of lead sight apparatus 20.

Within the barrel clamp 92 is a pair of bores 100 and 102. The bores are separated by a pair of webs 104 and 106, which extend inwardly of the barrel clamp. As may be seen in FIGS. 7 and 8, the webs 104 and 106 do not join, but rather extend inwardly a short distance for convenience in defining the bores 100 and 102, which in turn receive the shotgun barrels 82 and 84, respectively. The bores 100 and 102 are substantially the same size, with respect to their internal diameter, as are the external diameters of the barrels 82 and 84. Thus, when the lead sight apparatus 90 is disposed on the ends of the barrels 82 and 84 of the shotgun 80, adjacent the muzzles of the barrels, the lead sight apparatus 90 is relatively secure on the shotgun 80 and will not be easily dislodged therefrom by accidental means. The sloping outer surface 94 aids in installing the apparatus, as above discussed.

The arm 108 extends outwardly from the barrel clamp 92 substantially on the horizontal diameters of the bores 100 and 102, which are substantially parallel to each other. Similarly, the arm 114 extends outwardly from the barrel clamp 92 in substantial alignment with the arm 108 and on the horizontal diameters of the bores 100 and 102. The arms 108 and 114 thus extend radially outwardly with respect to the bores, and substantially perpendicular to the longitudinal axes of the bores of the barrel clamp 92. That is, generally the same arrangement, with respect to the orientation of the arms, as with the other embodiments of the invention, is used. The primary difference between the apparatus of FIGS. 7 and 8 and the previous embodiments is simply that lead sight apparatus 90 is designed to receive two barrels of a shotgun, rather than a single barrel, as discussed above.

The arms 108 and 114 include outer or distal rings 110 and 116, respectively, each of which includes a center aperture or bore 112 and 118, respectively. The length of the arms and the diameter of the rings is, as discussed above, correlated to the type of game being hunted.

Figure 8:
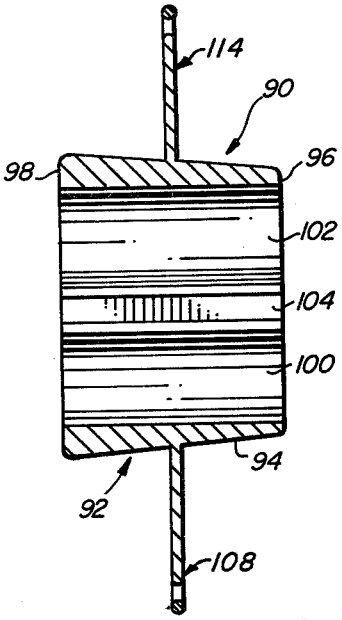
FIG. 8 is a view in partial section of the apparatus of FIG. 7 taken generally along line 8—8 of FIG. 7.
Figure 9:
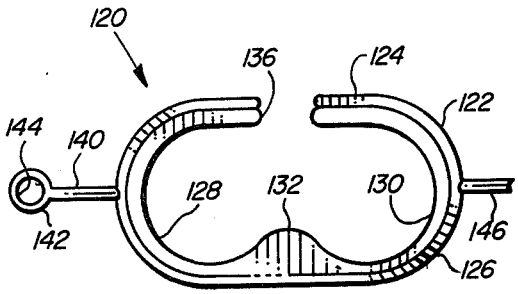
FIG. 9 is a front view of an alternate embodiment of the apparatus of FIGS. 7 and 8.

FIG. 9 comprises an end view of an alternate embodiment of the lead sight apparatus 90 of FIGS. 7 and 8. Lead sight apparatus 120 of FIG. 9 is, as is the lead sight apparatus 90 of FIGS. 7 and 8, designed to be used with a double barrel shotgun. The lead sight apparatus 120 includes a sloping outer surface 122 which extends between a front face 126 and a rear face (not shown). The ring sight apparatus 120 includes a barrel clamp 122 with a pair of arms 140 and 146 extending radially outwardly with respect to the bores 128 and 130, respectively. Arms 140 and 146 are aligned with each other and are disposed on the horizontal diameters of the bores 128 and 130. A web 132 extends upwardly between the bores 128 and 130 to help define the bores 128 and 130. The web also, of course, aids in holding the lead sight apparatus 120 onto the barrels of a shotgun, as do the webs 104 and 106 of lead sight apparatus 90 of FIGS. 7 and 8.

The lead sight apparatus 120 also includes a slot 136. The slot 136 extends longitudinally of the barrel clamp 122 between the front and rear faces and between the outer surface 124 and the juncture of the bores 120 and 130 and is aligned with the web 132.

The lead sight apparatus 120, with its slot 136, is similar to the lead sight apparatus 50 of FIGS. 4 and 5 in that the bores 120 and 130 may be made slightly smaller than the actual exterior of the shotgun barrels over which they are disposed. With the lead sight apparatus 120 being made of yieldable material, there is an inherent spring bias that helps to retain the lead sight apparatus 120 onto the barrels of a shotgun.

The arm 140, which extends outwardly from the outer surface 124 of the barrel clamp 122, is aligned with the arm 146, and both arms are on the horizontal diameters of the bores 128 and 130. A ring 142, with a bore or hole 144 extending therethrough, is secured to the distal end of the arm 140, remote from the barrel clamp 142. As with the other rings and arms, the arm 140 is secured on the horizontal diameter of the ring 142. The arm 146 also, of course, includes a ring with a hole or aperture extending therethrough (not shown).

Figure 10:
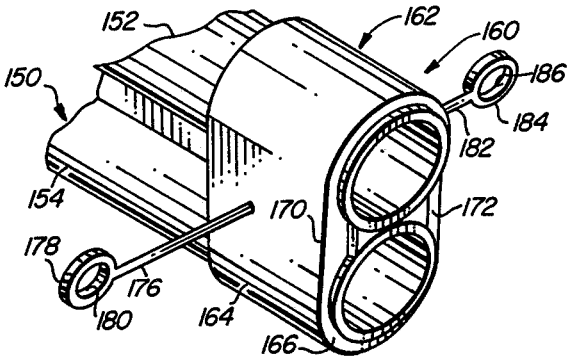
FIG. 10 is a perspective view of the apparatus of the present invention illustrating the use of the apparatus with an over-under shotgun.

FIG. 10 is a perspective view of a lead sight apparatus 160 secured to a pair of barrels 152 and 154 of a superimposed or over/under shotgun 150. The lead sight apparatus 160 includes a barrel clamp 162 and a pair of arms 176 and 182 extending outwardly from the barrel clamp.

The barrel clamp 162 includes a sloping outer surface 164 which extends from a front face 166, disposed adjacent the muzzles of the barrels 152 and 154, and a rear face, not shown. The outer surface 164 may be sloping, as with the embodiments of FIGS. 1-3, and 7 and 8, or it may be straight, substantially aligned with a pair of bores which extend longitudinally through the barrel clamp 162, such as shown with respect to the embodiment of FIGS. 4 and 5. As discussed, a sloping outer surface may aid in installing and removing the barrel clamp from a shotgun. However, such sloping surface is not necessary for the apparatus of the present invention.

Because the shotgun 150 is of the over/under type, the arms 176 and 182 do not extend on a diameter of either barrel, but rather are disposed between the barrels, but are parallel to the horizontal diameters of the barrels. The arm 176 includes a ring 178, with an aperture 180 extending therethrough, secured to the distal end of the arm 176, remote from the barrel clamp 162. The arm 182, which is aligned with the arm 176, also includes a ring secured to its distal end, and identified in FIG. 10 by reference numeral 184. The ring 184 includes an aperture or hole 186 extending therethrough. As with all the embodiments of the present invention, the length of the arms 176 and 182, and the size or diameter of the rings 178 and 184, are appropriately correlated for the game which is being hunted.

Figure 11:
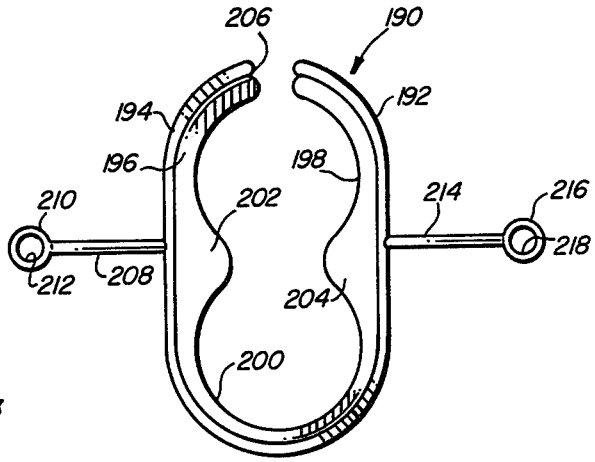
FIG. 11 is a front view of an alternate embodiment of FIG. 10.

FIG. 11 is a front view of an alternate embodiment of the apparatus shown in FIG. 10. It comprises a front view of lead sight apparatus 190 adapted for use with an over/under shotgun. The lead sight apparatus 190 includes a barrel clamp 192 with a pair of aligned arms 208 and 214 extending outwardly from the barrel clamp, and disposed substantially perpendicular to the longitudinal axis of a pair of bores 198 and 200.

The barrel clamp 192 includes a sloping outer surface 194 which extends from a front face 196 rearwardly to a rear face (not shown). The bores 198 and 200 are substantially parallel to each other and extend longitudinally through the barrel clamp 192. A pair of webs 202 and 204 extend inwardly with respect to the barrel clamp 192 between the bores 190 and 200. They help to define the bores, as discussed above. They also serve to help clamp or hold the lead sight apparatus 190 onto a shotgun.

The arms 208 and 214 extend outwardly in alignment with each other and generally between the bores 198 and 200. The arm 208 includes a ring 210 secured to its distal end, with a hole or aperture 212 extending through the ring. As with all other embodiments, the rings 210 and 216 are disposed on, and secured to, the arms 208 and 214 on their respective horizontal diameters, and on the horizontal diameter of the bore of the clamp.

The lead sight apparatus 190 differs from the lead sight apparatus 160 of FIG. 10 in that the lead sight apparatus 190 includes an axially extending slot 206. The slot 206 communicates with the bore 198 and extends the length of the barrel clamp 192, between the front face 196 and the rear face of the barrel clamp. As with the other embodiments of the apparatus of the present invention which include a slot, the slot allows the diameter of the bore 198, and perhaps the bore 200, to be made slightly smaller in diameter than the diameter of the shotgun barrels to which the lead sight apparatus 190 will be secured, to provide an inherent spring bias for securing the apparatus to a shotgun.

A slotted barrel clamp, such as shown in FIGS. 4, 5, 6, 9, and 11, is preferable to the continuous barrel clamp because the apparatus may then be placed on a shotgun barrel with the arms aligned with the bead normally found on the top of the barrel.

The primary purpose of a ring is to locate the target game relative to the barrel of the shotgun. That is, the game is located so as to be within a specified or predetermined area relative to the center of the bore of the barrel of the shotgun. The ring thus confines the game when the ring is superimposed on the game, with the game centered in the ring.

As indicated above, the size of a ring should be small enough to be correlated with the length of its arm, and large enough to clearly identify game through the ring. The size of the ring will accordingly vary with the optimum distance of shot for which an individual lead sight apparatus is designed. For optimum short, intermediate, or long range shots, different apparatus should be prepared, with both the size of the rings and arms varying with each apparatus.

In the table below, several different types of game are listed, with the overall or combined size (width) of a ring and length of its arm given for various types of game. The dimensional information varies for different gages of shotguns since the bore diameter of the barrel is different for each gage. Accordingly, the total thickness of a barrel clamp plus the radius of the bore and thickness of the barrel varies. However, for any one gage this total distance is constant, and the only variable is the speed or velocity of the game. The overall or combined length of an arm and a ring therefore varies in the table only for the game being hunted for each gage of shotgun.

Within the given parameters and variables which are necessarily involved with any type of hunting situation, the use of lead sight apparatus of the present invention substantially increases the accuracy of an "average" hunter, when the apparatus of the present invention is correlated to the table. For calculation purposes of the table, it is assumed that the optimum distance from the shooter to the game is about fifty yards. The gravitational drop in shot over the fifty yard distance is calculated or predetermined so that the game, if a ring is superimposed on the game, will be in the center of the shot pattern. The rings are accordingly disposed on the horizontal diameter of the shotgun barrel so as to be substantially aligned with the longitudinal axis of the barrel.

The dimensional information is listed in inches from the outer edge of a ring to the juncture of an arm with a barrel clamp. With any given gage of shotgun, the distance from the center of the barrel to the juncture of an arm and the barrel clamp is known and thus is a fixed or constant dimension and not a variable. The only variable, then, for each gage, is the combined length of arm and ring, identified in FIG. 4 as distance "X".

Table of Dimensions (In Inches)

| | Duck | Pheasant | Quail | Cottontail Rabbit |
|---|---|---|---|---|
| 16 gage | .725 | .600 | .620 | .500 |
| 20 gage | .775 | .700 | .650 | .550 |
| 28 gage | .790 | .720 | .675 | .580 |
| .410 gage | .815 | .750 | .715 | .600 |

Dimensions refer to distance "X" in FIG. 4.

What is claimed is:

1. Lead sight apparatus for securing to a shotgun barrel, comprising, in combination:

a barrel clamp for securing the apparatus to the barrel of a shotgun, including a bore for receiving the barrel substantially coaxial with the barrel of the shotgun;

a first arm and a second arm secured to the barrel clamp in axial alignment with each other on a diameter of the bore of the clamp for orientation on the shotgun barrel so as to be on the horizontal diametrical axis of the shotgun barrel;

first ring means secured to the first arm remote from the barrel clamp, and second ring means secured to the second arm remote from the barrel clamp, with the rings disposed diametrically relative to the arms and accordingly diametrically relative to the barrel of the shotgun; and the length of the arms and the size of the rings being predetermined for the type of game being hunted, the gage of the shotgun, and the optimum distance of a shot to provide the proper lead by a user of the shotgun when sighting a shotgun when a ring is superimposed on the predetermined moving game.

2. The apparatus of claim 1 in which the first and second ring means have an aperture extending through each ring means.

* * * * *